US009726444B1

(12) United States Patent
Sisk

(10) Patent No.: US 9,726,444 B1
(45) Date of Patent: Aug. 8, 2017

(54) TACTICAL ADAPTIVE RIFLE STOCK

(71) Applicant: Charles H. Sisk, Dayton, TX (US)

(72) Inventor: Charles H. Sisk, Dayton, TX (US)

( * ) Notice: Subject to any disclaimer, the term of this patent is extended or adjusted under 35 U.S.C. 154(b) by 405 days.

(21) Appl. No.: 13/999,780

(22) Filed: Mar. 20, 2014

(51) Int. Cl.
*F41A 3/66* (2006.01)
*F41C 23/14* (2006.01)
*F41C 23/16* (2006.01)
*F41C 23/20* (2006.01)

(52) U.S. Cl.
CPC ..... *F41A 3/66* (2013.01); *F41C 23/14* (2013.01); *F41C 23/16* (2013.01); *F41C 23/20* (2013.01)

(58) Field of Classification Search
CPC ..... F41C 23/16; F41C 23/14; F41C 23/06; F41A 11/02; F41A 3/66
See application file for complete search history.

(56) References Cited

U.S. PATENT DOCUMENTS 4,203,244 A 5/1980 Hickman
4,242,826 A * 1/1981 Anschutz ..... F41C 23/16 42/73
4,769,937 A 9/1988 Gregory et al.
4,896,446 A 1/1990 Gregory
5,075,995 A 12/1991 Kennel
5,247,758 A 9/1993 Mason
5,711,102 A 1/1998 Plaster et al.
6,467,212 B1 10/2002 Apel
7,152,355 B2 12/2006 Fitzpatrick et al.
7,162,823 B2 * 1/2007 Schoppman ..... F41A 11/04 42/75.01
7,536,819 B2 5/2009 Popikow
7,665,240 B1 * 2/2010 Bentley ..... F41A 11/02 42/71.01
7,762,018 B1 7/2010 Fitzpatrick et al.
7,926,217 B2 * 4/2011 McCann ..... F41C 23/16 42/75.02
7,930,849 B2 4/2011 Abraham et al.
8,307,575 B1 * 11/2012 Battaglia ..... F41A 3/64 42/75.03
D763,396 S * 8/2016 Juarez ..... D22/108
(Continued)

FOREIGN PATENT DOCUMENTS

GB 1011964 A * 12/1965 ..... F41A 3/26

*Primary Examiner* — Benjamin P Lee
(74) *Attorney, Agent, or Firm* — Gordon K. Anderson

(57) ABSTRACT

An improved tactical adaptive rifle stock is taught which includes a multi-axis adjustable buttstock, and a fore-end consisting of a receiver portion and a forestock, together forming a combined set, which is attached to a flanged stock bolt of the buttstock. The receiver portion includes a cavity forming a receiver bedding interface surface precluding peripheral interference. The receiver portion has a recoil lug pocket with threaded fasteners engaging a rifle action recoil lug. A locking wedge is positioned in a recess of the receiver portion and dovetail grooves are included in a forward end. The forestock incorporates dovetail grooves that mate with the receiver portion grooves when secured with a wedge and wedge threaded fastener. The buttstock, receiver portion and forestock have lightening areas for reducing overall weight. A second embodiment utilizes an adapter, a connector and an AR-15 style handguard or a suppressor, replacing the fore-stock and a third embodiment employs a one piece fore-end.

5 Claims, 7 Drawing Sheets

(56) References Cited

U.S. PATENT DOCUMENTS

| | | | | |
|---|---|---|---|---|
| 2007/0089347 | A1* | 4/2007 | Webber | F41A 11/02 42/75.03 |
| 2008/0190005 | A1* | 8/2008 | Rohrauer | F41A 3/66 42/75.01 |
| 2009/0288324 | A1* | 11/2009 | Peterson | F41A 11/02 42/75.03 |
| 2010/0132240 | A1 | 6/2010 | Webber et al. | |
| 2012/0073177 | A1* | 3/2012 | Laney | F42B 5/025 42/16 |
| 2012/0137556 | A1* | 6/2012 | Laney | F41C 23/16 42/6 |
| 2013/0232841 | A1* | 9/2013 | Knoebel | F41C 23/16 42/71.01 |
| 2015/0219416 | A1* | 8/2015 | Chvala | F41C 23/04 42/71.01 |

* cited by examiner

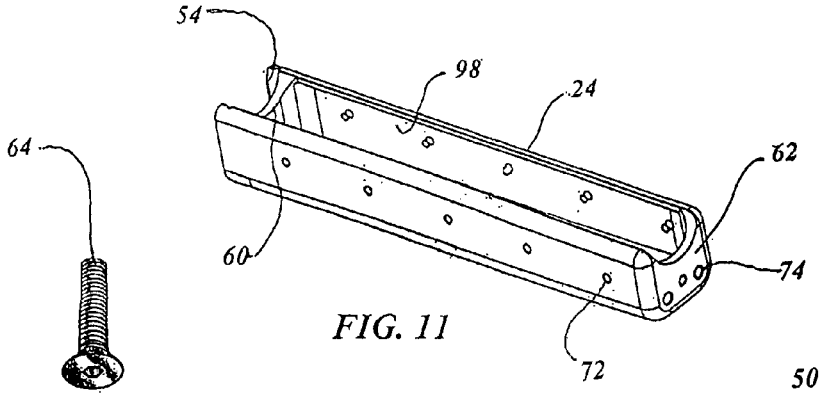
FIG. 11
FIG. 12
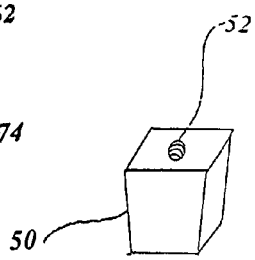
FIG. 13
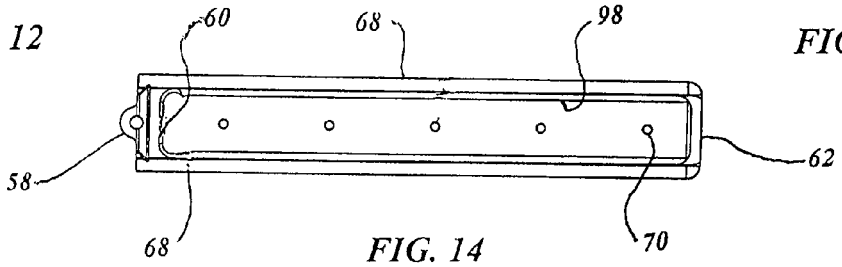
FIG. 14
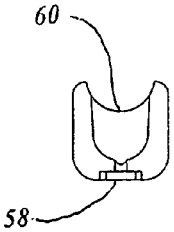
FIG. 15
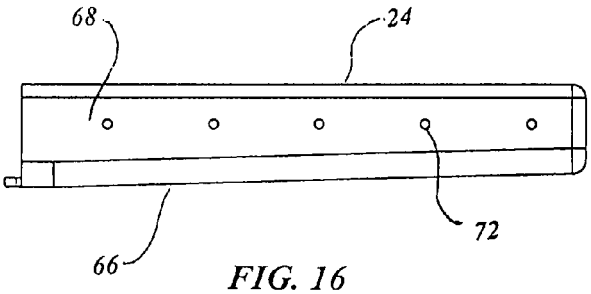
FIG. 16
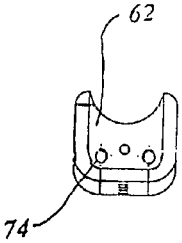
FIG. 17
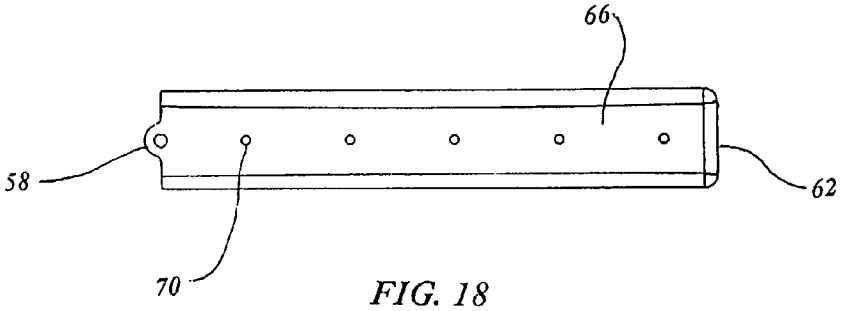
FIG. 18

TACTICAL ADAPTIVE RIFLE STOCK

TECHNICAL FIELD

The present invention relates to gunstocks in general. More specifically to a metallic forestock used in conjunction with a metallic buttstock that incorporates numerous adjustments for ultimate ergonomics.

BACKGROUND OF THE INVENTION

Previously, many types of adjustable features in a firearm butt stock have been used in endeavoring to provide an effective means to compensate for the variation in the physical requirements of the shooter. Further many attempts have been made to provide the furthermost stiffness in bedding of a receiver to a stock for extreme accuracy.

The prior art listed below did not disclose patents that possess any of the novelty of the instant invention; however the following U.S. patents are considered related:

| U.S. Pat. No. | Inventor | Issue Date |
|---|---|---|
| 4,203,244 | Hickman | May 20, 1980 |
| 4,769,937 | Gregory et al. | Sep. 13, 1988 |
| 4,896,446 | Gregory | Jan. 30, 1990 |
| 5,075,995 | Kennel | Dec. 31, 1991 |
| 5,247,758 | Mason | Sep. 28, 1993 |
| 5,711,102 | Plaster et al. | Jan. 27, 1998 |
| 6,467,212 B2 | Apel | Oct. 22, 2002 |
| 7,152,355 B2 | Fitzpatrick et al. | Dec. 26, 2006 |
| 7,536,819 B2 | Popikow | May 26, 2009 |
| 2010/0132240 A1 | Webber et al | Jun. 2, 2010 |
| 7,762,018 B1 | Fitzpatrick et al. | Jul. 27, 2010 |
| 7,930,849 B2 | Abraham et al. | Apr. 26, 2011 |

Hickman in U.S. Pat. No. 4,203,244 teaches an attachment to elevate a shooter's line of sight above the barrel. The attachment includes a recoil absorbing pad and a stock elevator rounded to fit a shooter's cheek with a set screw for elevating the adjustment. The attachment is mountable to a variety of firearms and may be removed without permanent stock modifications.

U.S. Pat. No. 4,769,937 issued to Gregory et al. is for a pneumatic recoil reduction in device fitted into the but end of a shotgun stock. An air cylinder is located closest to the butt end permitting adjusting the pressure in the cylinder without disassembly.

Gregory in U.S. Pat. No. 4,896,446 discloses an adjustable comb and butt plate for shoulder firearms consisting of a butt plate with recoil absorbing means and a combined slideable and removable comb. The butt plate permits length and/or a different pitch down angle with means accessible from the exterior of the stock.

Kennel in U.S. Pat. No. 5,075,995 teaches a gunstock which includes a contoured pistol handgrip face engaging portion and longitudinal stock cast enabling the user to absorb the recoil with a uniform sighting position.

Mason in U.S. Pat. No. 5,247,758 presents a mounting structure for bedding an action and barrel in a stock utilizing a rigid truss structure between the receiver and post isolating the receiver and forward barrel sections from associated vibrations.

U.S. Pat. No. 5,711,102 issued to Plaster et al. is for a configurable sniper rifle stock having a wide forearm and narrow carrying portion with the action mounted rearward. A stippled grip and a interchangeable cheek piece on the butt stock, with spacers used to adjust the length of pull.

Fitzpatrick et al. in U.S. Pat. No. 7,152,355 B2 disclose a modular stock system replacing a rifle buffer tube with one containing a mount for constant cheek weld and a rail track for adjustment. A stock module mounts on the replacement buffer tube and is interchangeable with fixed and specialized stocks.

U.S. Pat. No. 7,762,018 B1 also of Fitzpatrick et al. is for a modular gunstock for AR15/M16 rifles having a receiver extension tube with a sleeve slideable over the attachment which contains mounting structure. The module is adjustable for length and features a length pre-set system, a latch with independent dual-pawls, an integrated impact buffer, modular tail-piece and storage also a position selectable fixed cheek plate.

Abraham et al. in U.S. Pat. No. 7,930,849 B2 is for a butt stock for a rifle having an adjustable cheek rest, a shoulder pad for adjusting the length of pull and angle from 0 to 300 degrees such that the body could function as a cheek rest even if the adjustable cheek rest were to be disconnected.

For background purposes and as indicative of the art to which the invention is related reference may be made to the remaining cited patents issued to Apel in U.S. Pat. No. 6,467,212 B2, Fitzpatrick et al. in U.S. Pat. No. 7,647,719 B2, Popikow in U.S. Pat. No. 7,536,819 B2 and Webber et al in U.S. Patent Application Publication 2010/0132240 A1

These and other objects and advantages of the present invention will become apparent from the subsequent detailed description of the preferred embodiment and the appended claims taken in conjunction with the accompanying drawings.

DISCLOSURE OF THE INVENTION

There is in present production my multi-axis adjustable buttstock which consists of an interfaced set of two serrated grip retainers attached onto the buttstock grip neck for buttstock tilt adjustment, with a number of selectable flat and tapered grip spacers for adjusting the trigger grip length, cast and drop. A flanged stock bolt is disposed through the buttstock for attachment purposes. A threaded rod in the buttstock creates length of pull adjustment and a recoil pad adapter plate, is attached to achieve recoil pad slant, height and angle adjustments.

It is therefore a primary object of the invention is to provide a suitable forend segment to complete a tactical adaptive rifle stock that would be compatible with the existing buttstock. A combined set consisting of a receiver portion and a forestock permit numerous combinations to be achieved as they may be used together or separated to change the overall lengths, utilize specialized sections or a completely different embodiment. The receiver portion incorporates four threaded holes aligned in a bolt circle in the rear for interfacing with the existing buttstock flanged stock bolt with attachment only requiring four threaded fasteners to create a secure and strong connection.

An important aspect of the invention is the novelty and uniqueness of the entire rifle fore-end itself which consists of a receiver portion and a removable forestock. The receiver portion contains a rifle action and barrel cavity forming a receiver bedding interface surface with a radius in the receiver portion larger than a radius of the rifle receiver which forms a uniform converging contact point permitting the actions front and rear trigger guard to apply pressure to the rifle action in a constant longitudinal alignment following the centerline of the fore-end without any peripheral interference from the balance of the fore-end.

Another attribute of the invention is that the receiver portion has a recoil lug pocket, permitting threaded fasteners to engage the front face of the recoil lug compressing the recoil lug against the rear face of the recoil lug pocket. Further threaded fasteners engage the right side and left side of the recoil lug therefore retaining the recoil lug within the receiver portion on all four sides permanently aligning the action into a firm unyielding surface completely immune to moisture, atmospheric temperature and humidity variations. As the rifle barrel is completely free floating it is not influenced in any way by the fore-end permitting the barrels natural harmonics to occur.

Still another feature of the fore-end is that the receiver portion is firmly attached to the forestock utilizing vertical dovetail grooves in the forward end and a recessed semi-circular recess at the bottom with opposed grooves and circular recesses in the forestock. A locking wedge, having a threaded bore, is positioned in a recess adjacent to the recoil lug pocket. When the receiver portion is attached to the forestock a threaded fastener urges the wedge to compress the grooves into a secure close-fitting relationship.

Another attribute of the invention is that the a rifle action and barrel cavity and receiver bedding interface surface is configured to receive either a rifle receiver short action or a rifle receiver long action, since this is an industry description of the action length used for a specific group of center fire cartridges.

One of the important objects of the invention is featured in the second embodiment which replaces the forestock with an adapter attached to the receiver portion and a connector, having male threads, interfacing with either an AR-15 style free float handguard or a suppressor completely enclosing the rifle barrel. The handguard permits the barrel to float freely without touching anything including entire barreled action except a longitudinal recess bedding interface surface and the four sides of its recoil lug in the receiver portion. The suppressor is self explanatory in that it encloses the entire barrel, which attenuates the sound, and has only an exit opening in the front allowing the bullet to proceed in its usual flight trajectory.

A final aspect it that the third embodiment introduces a piece stock which eliminates the dovetail joints while still retaining the remaining bedding features which enhance the overall accuracy of the rifle. Another motivation of this embodiment is the ability to utilize different materials in the fore-stock of a rifle, and other firearms, such as wood, epoxy laminated wood, polymer, and fiberglass and even formed steel sheet material. Further the buttstock is rapidly removed from the stock fore-end by rotating the first threaded lock ring then sliding the buttstock from the flanged stock bolt, creating a quick release joint with no tools required.

These and other objects and advantages of the present invention will become apparent from the subsequent detailed description of the preferred embodiment and the appended claims taken in conjunction with the accompanying drawings.

BRIEF DESCRIPTION OF THE DRAWINGS

FIG. 11 is an isometric view of the forestock in the preferred embodiment.

FIG. 12 is an isometric view of the locking wedge threaded fastener in the preferred embodiment.

FIG. 13 is an isometric view of the locking wedge in the preferred embodiment.

FIG. 14 is top elevation view of the forestock in the preferred embodiment.

FIG. 15 is a left end view of the forestock in the preferred embodiment.

FIG. 16 is a front elevation view of the forestock in the preferred embodiment.

FIG. 17 is a right end view of the forestock in the preferred embodiment.

FIG. 18 is a bottom view of the forestock in the preferred embodiment.

BEST MODE FOR CARRYING OUT THE INVENTION

Figure 1:
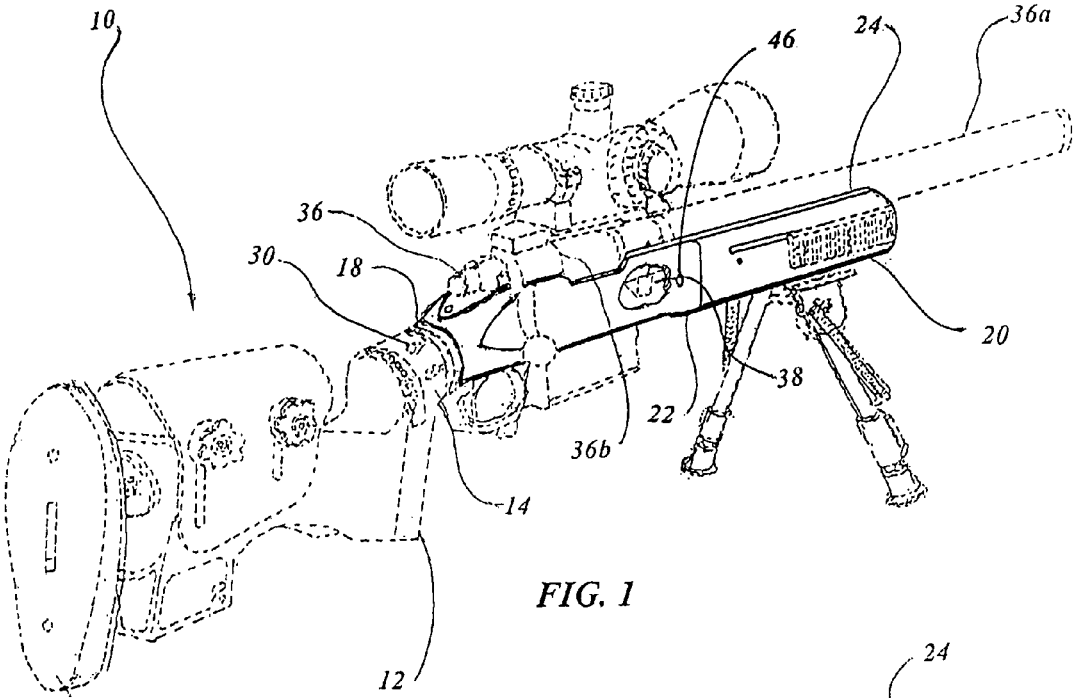
FIG. 1 is the preferred embodiment depicted in a partial isometric view of the tactical adaptive rifle stock combined set having a receiver portion and a forestock which is illustrated with solid lines and the remainder, including the a multi-axis adjustable buttstock, rifle and various auxiliary accessories shown in dash lines.
Figure 2:
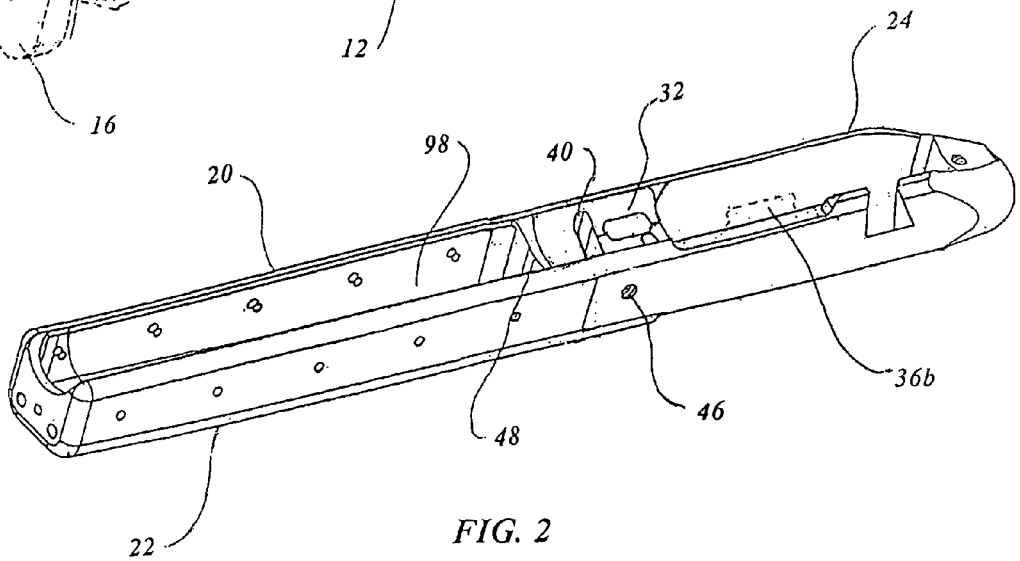
FIG. 2 is an isometric view of the fore-end with the attached receiver portion and forestock forming the combined set in the preferred embodiment.
Figure 4:
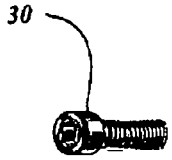
FIG. 4 is an isometric view of the locking wedge threaded fastener in all of the embodiments.
Figure 6:
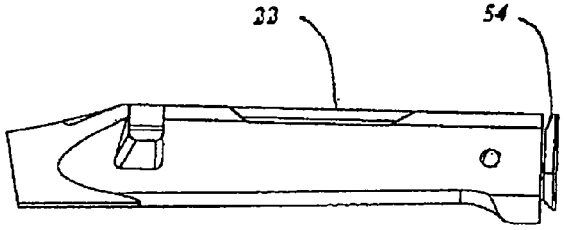
FIG. 6 is a front elevation view of the receiver portion in the preferred embodiment.

The best mode for carrying out the invention is presented in terms of a preferred, a second and a third embodiment. The preferred embodiment is shown in FIGS. 1, 2 and 4 thorough 18 which is comprised of a tactical adaptive rifle stock 10. The rifle stock 10 includes an existing multi-axis adjustable buttstock 12, having a grip neck 14, a butt 16 and a flanged stock bolt 18 which is disposed through a portion of the buttstock 12.

Figure 5:
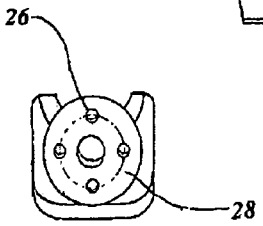
FIG. 5 is a left side view of the receiver portion in the preferred embodiment

A stock fore-end set 20, which is illustrated in FIG. 2, consists of a receiver portion 22 and a forestock portion 24, with the receiver portion 22 incorporating a number of rear threaded holes 26 aligned in a bolt circle 28, illustrated in FIG. 5, and buttstock threaded fasteners 30, depicted in FIG. 4 for connecting the buttstock flanged stock bolt 18 to the threaded holes 26 in the receiver portion 22.

Figure 7:
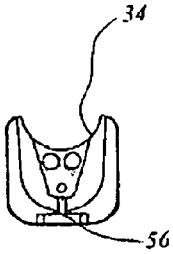
FIG. 7 is a right side view of the receiver portion in the preferred embodiment.
Figure 9:
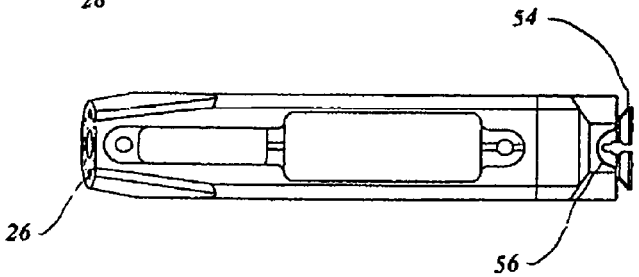
FIG. 9 is a bottom view of the receiver portion in the preferred embodiment.
Figure 8:
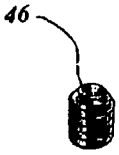
FIG. 8 is an isometric view of one of the recoil lug side threaded fasteners in the preferred embodiment.

The receiver portion 22 incorporates a rifle action and barrel cavity 32, shown in FIG. 2, forms a longitudinal receiver bedding interface surface 34, illustrated in FIG. 7. The radius in the receiver portion is larger than the radius of a rifle action 36 providing the uniform converging contact point, permitting a rifle action front trigger guard screw and a rear trigger guard screw to apply compressive pressure to the rifle action 36 creating the constant longitudinal alignment without peripheral interference.

The rifle action 36 includes a barrel 36*a* and has a short action receiver or a long action receiver 36*b*. The short action receiver is illustrated in the drawings and the long is not shown, however, it incorporates the same features except its overall length is greater. The short and long action designation is well known in the industry and the tactical adaptive rifle stock 10 embraces either configuration.

Figure 3:
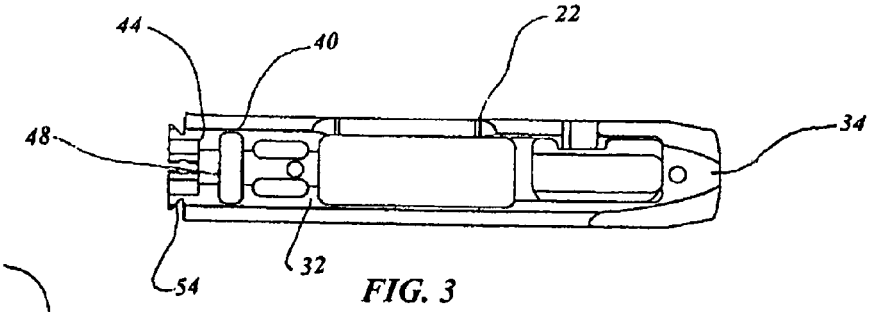
FIG. 3 is a top plan view of the receiver portion in the preferred embodiment.
Figure 10:
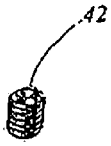
FIG. 10 is an isometric view of one of the recoil lug front face threaded fasteners in the preferred embodiment.
Figure 19:
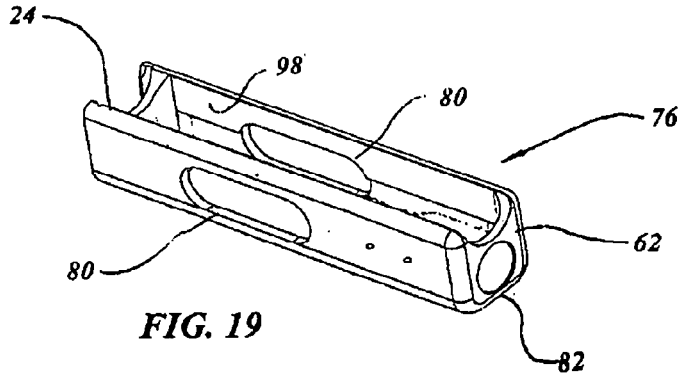
FIG. 19 is an isometric view of a forestock, with the flashlight accommodations, in an alternate embodiment.
Figure 20:
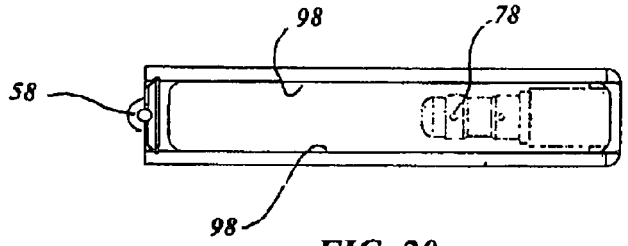
FIG. 20 is a top plan view of the forestock, with the flashlight accommodations and a flashlight shown in dashed lines in an alternate embodiment.
Figure 21:
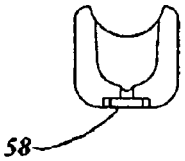
FIG. 21 is a left end view of the forestock, with the flashlight accommodations, in an alternate embodiment.
Figure 22:
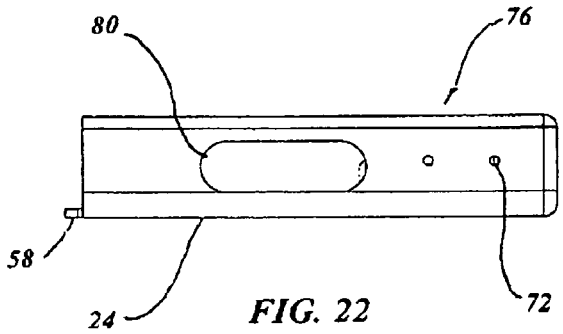
FIG. 22 is a side elevation view of forestock, with the flashlight accommodations, in an alternate embodiment.
Figure 23:
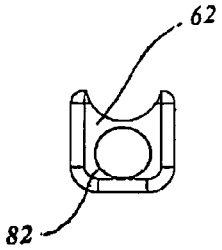
FIG. 23 is a right end view of the forestock, with the flashlight accommodations, in an alternate embodiment.
Figure 24:
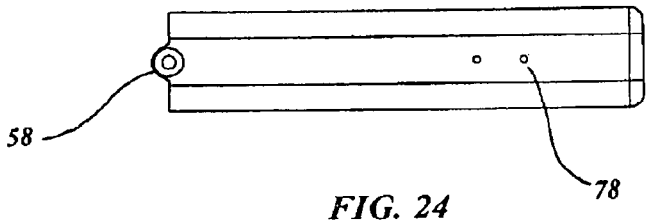
FIG. 24 is a bottom view of the forestock, with the flashlight accommodations, in an alternate embodiment.

The receiver portion 22 is adapted to conform to the rifle action 36 having a recoil lug 38, with the receiver portion 22 having a recoil lug pocket 40, depicted in FIG. 3, with a bottom, a rear face, a front face and sides. Two front face threaded fasteners 42, shown in FIG. 10, engage the front face of the recoil lug 38 through threads in the forward bulkhead 44 and compress the recoil lug 38 against the rear face of the recoil lug pocket 40. A recoil lug side threaded fastener 46, in the form of a socket head set screw, engage a right side and left side of the recoil lug 38 thereby centering and retaining the sides of the recoil lug 38 within the receiver portion 22. The recoil lug 38 is positioned above the bottom of the recoil lug pocket 40 in order to permit the longitudinal receiver bedding interface surface 34 to accomplish the sole longitudinal receiver bedding interface surface 34.

The receiver portion 22 incorporates a locking wedge recess 48 positioned adjacent to the recoil lug pocket 40, with a locking wedge 50, illustrated in FIG. 13, including a threaded bore 52. The receiver portion 22 further includes a set of vertical dovetail grooves 54 in a forward side and a semi-circular recess 56 in a forward bottom end.

The forestock portion 24 illustrated in FIGS. 11-18 and has a dovetail joint 54, a semi-circular outwardly facing platform 58, a rear bulkhead 60 and a front face 62. The forestock portion 24 includes a bottom 66 and sides 68 each having a plurality of threaded bottom holes 70 and threaded side holes 72 adapted to mate with military specification Picatinny Rail hole spacing's. The forestock portion front face 62 has a number of accessory front face threaded holes 74 that continue completely through. The forestock portion 24 may be any overall length, however it is preferred that the forestock portion has an overall length of 6.25, 8.25 and 10.25 inches (15.88, 20.96 and 25.11 cm) which is a typical for a tactical stock of this type.

The forestock portion 24 optionally includes accommodations for mounting a flashlight which is designated the flashlight forestock 76 as illustrated in FIGS. 19-24, which includes a plurality of flashlight threaded holes 78 interfacing with a specific tactical flashlight. Further the forestock portion 24, for this option, incorporates side slots 80 for manipulating the flashlight switch, and a round opening 82 in the front face 62 for the light beam to pass through.

The fore-end receiver portion 22 and forestock portion 24 combined set 20 are individually made of aluminum, preferably anodized. Specifically the multi-axis adjustable buttstock 12, receiver portion 22 and forestock portion 24 include lightening areas 98 in the interior to reduce the overall weight of the tactical adaptive rifle stock.

The forestock portion 24 is united with the receiver portion 22, by utilizing the dovetail joint 54 and the semi-circular platform 58 simultaneously juxtaposes with the semi-circular recess 56. When a locking wedge threaded fastener 64 enters the locking wedge bore 52, and is tightened, the receiver portion 22 and the forestock portion 24 are fully mated together, forming the combined set 20 for the tactical adaptive rifle stock 10. The fore-end 20, combined receiver portion 22 and forestock portion 24 have lightening areas 94 for reducing overall weight.

Figure 25:
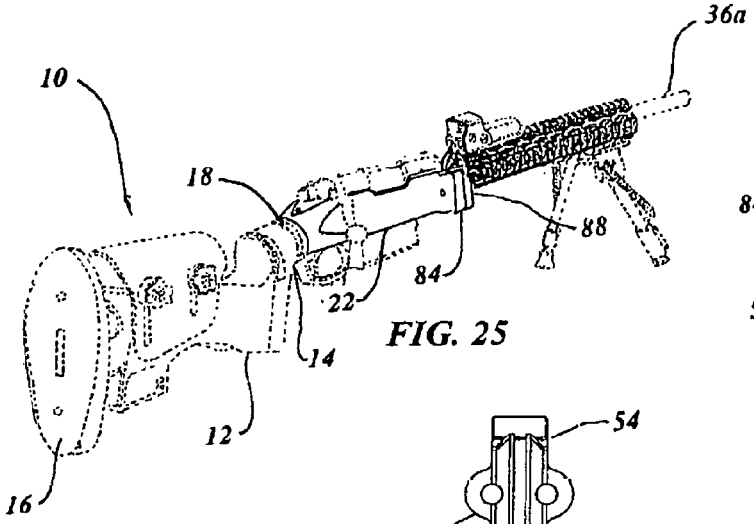
FIG. 25 is a partial isometric view of the tactical adaptive rifle stock in the second embodiment replacing the forestock with an adapter attached to the receiver portion and a free float handguard connector attached to the adapter and an AR-15 type free float handguard screwed onto the adapter.
Figure 26:
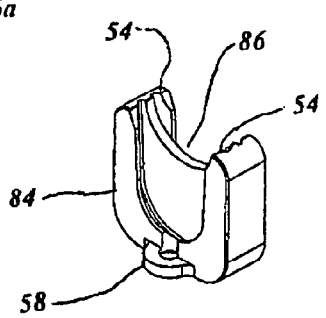
FIG. 26 is an isometric view of adapter in the second embodiment.
Figure 27:
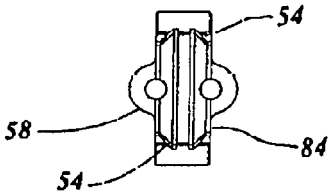
FIG. 27 is top elevation view of the adapter in the second embodiment.
Figure 28:
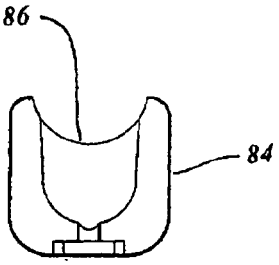
FIG. 28 is a left end view of the adapter in the second embodiment.
Figure 29:
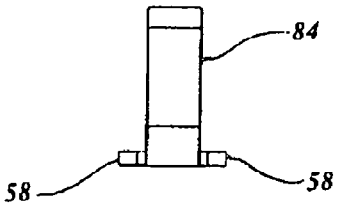
FIG. 29 is a front elevation view of adapter in the second embodiment.
Figure 30:
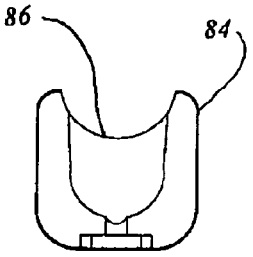
FIG. 30 is a right end view of the adapter in the second embodiment.
Figure 31:
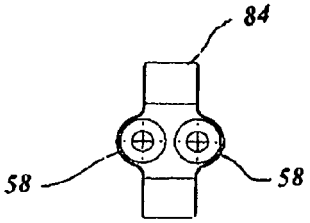
FIG. 31 is a bottom view of the adapter in the second embodiment.
Figure 32:
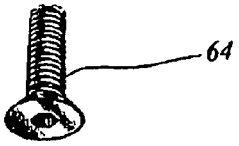
FIG. 32 is an isometric view of the locking wedge threaded fastener in the second embodiment.
Figure 33:
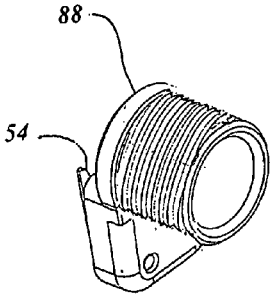
FIG. 33 is an isometric view of the free float handguard connector in the second embodiment.

The second embodiment of the tactical adaptive rifle stock 10 is depicted in FIG. 25 and the details are shown in FIGS. 26-41. The second embodiment utilizes the same buttstock 12 which is attached only to the receiver portion 22 with the forestock portion 24 replaced by an adapter 84 which is connected directly to the receiver portion 22. The adapter 84 consists of a mating vertical dovetail joint 54 in a rearward end, a semi-circular outwardly facing platform 58 on a bottom portion, a bulkhead 86, and a vertical dovetail joint 54 in a foreword end. The adapter 84 is united with the receiver portion 22 and mates with the dovetail joint and platform 58. When the locking wedge threaded fastener 64 enters the locking wedge bore 52 the receiver portion 22 and adapter 84 engage together in a rigid manner extending the length of the receiver portion 22.

A connector 88 engages the adapter 84 together forming a combined set. The connector 88 incorporates the same vertical dovetail joint 54 in a rearward end and a semi-circular outwardly facing platform 58 on a bottom portion. The connector 88 interfaces with the adapter 84, and a second locking wedge threaded fastener 64 enters the adapter semi-circular outwardly facing platform 58 and engages a second locking wedge 50 the combined set is completed.

Figure 34:
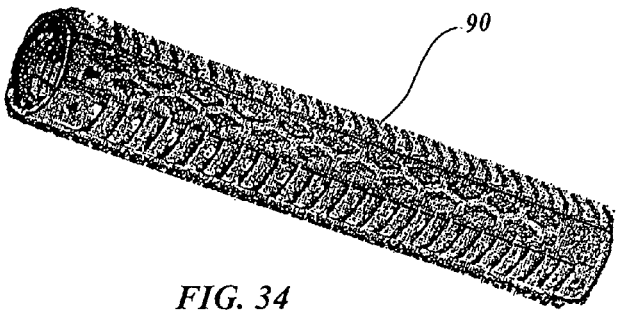
FIG. 34 is an isometric view of an AR-15 type free float handguard in the second embodiment.
Figure 35:
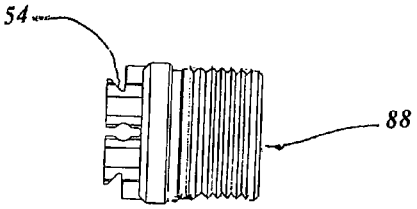
FIG. 35 is top elevation view of the free float handguard connector in the second embodiment.
Figure 36:
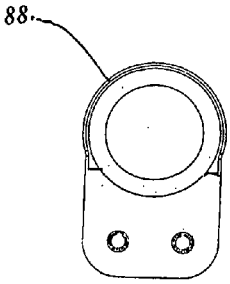
FIG. 36 is a left end view of the free float handguard connector in the second embodiment.
Figure 37:
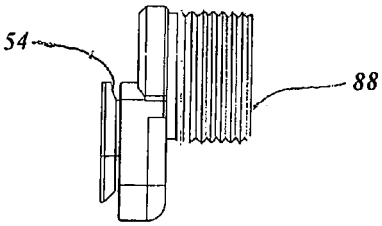
FIG. 37 is a front elevation view of the free float handguard connector in the second embodiment.
Figure 38:
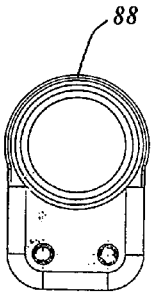
FIG. 38 is a bottom view of the free float handguard connector in the second embodiment.
Figure 39:
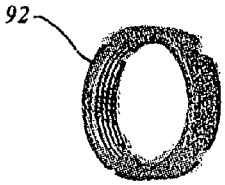
FIG. 39 is an isometric view of an AR-15 type castle nut in the second embodiment.
Figure 40:
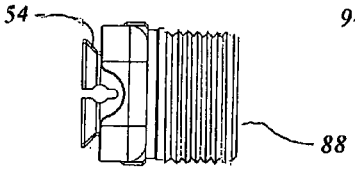
FIG. 40 is a bottom view of the free float handguard connector in the second embodiment.
Figure 41:
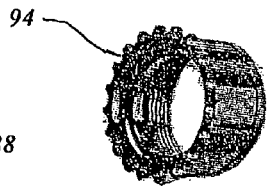
FIG. 41 is an isometric view of an AR-15 type barrel nut in the second embodiment.

An AR-15 type free float handguard 90, depicted in FIG. 34, is screwed onto the connector 88 with attachment means consisting of a barrel nut 92 and a castle nut 94, illustrated in FIGS. 34, 39, and 40 completing the second embodiment.

The second embodiment also includes an alternate feature comprising the same adapter 84 and connector 88 which replaces the forestock portion 24 except a noise reduction suppressor 100 instead of the AR-15 type free float handguard 90. The suppressor is secured to the connector 88 which incorporates male threads and the suppressor 100 having mating female threads. The suppressor 100, which attenuates the sound, encloses the entire barrel 36*a*, and has only an exit opening in the front allowing the bullet to leave untouched.

Figure 42:
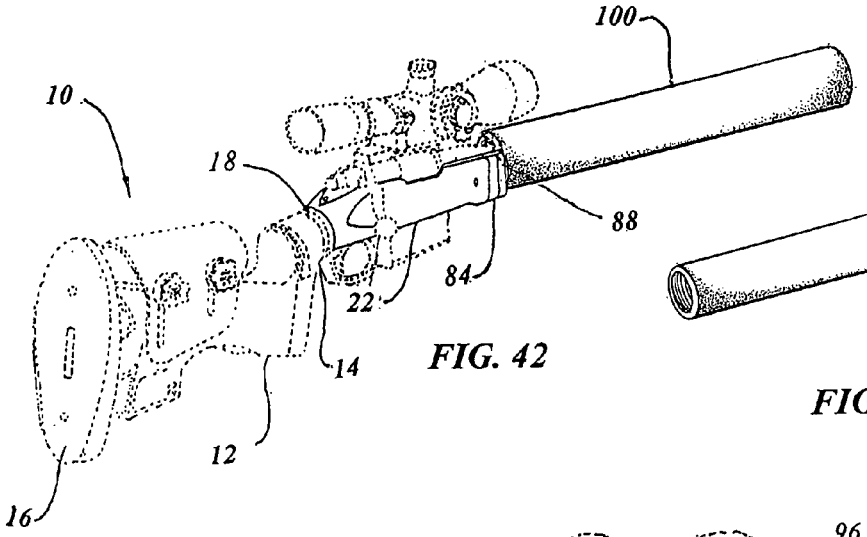
FIG. 42 is a partial isometric view of the tactical adaptive rifle stock in the second embodiment replacing the forestock with an adapter attached to the receiver portion and a handguard connector attached to the adapter with a sound suppressor screwed onto the adapter.
Figure 43:
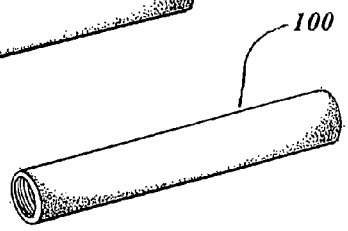
FIG. 43 is an isometric view of a suppressor in the second embodiment.
Figure 44:
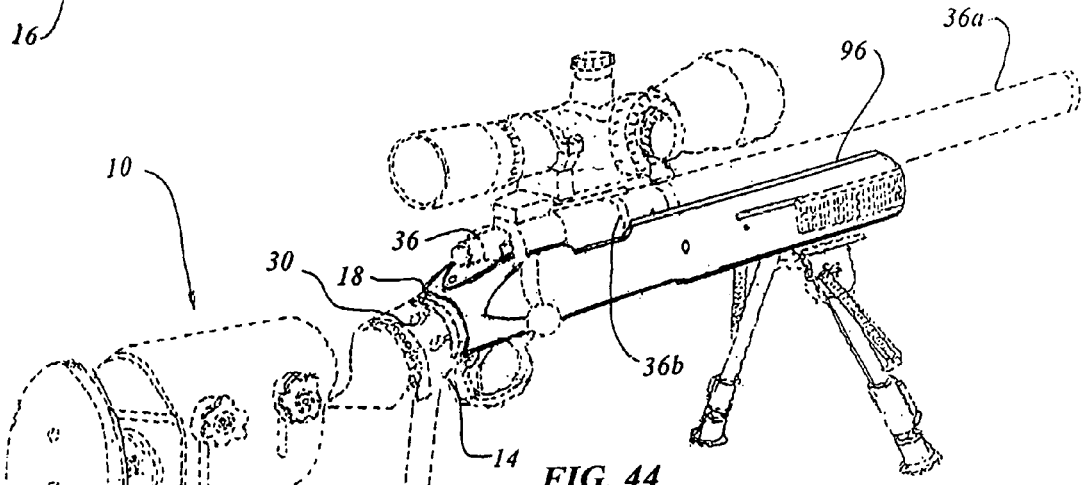
FIG. 44 is the third embodiment depicted in a partial isometric view of the tactical adaptive rifle stock combined set having a one piece stock fore-end which is illustrated with solid lines and the remainder, including the a multi-axis adjustable buttstock, rifle and various auxiliary accessories shown in dash lines.
Figure 45:
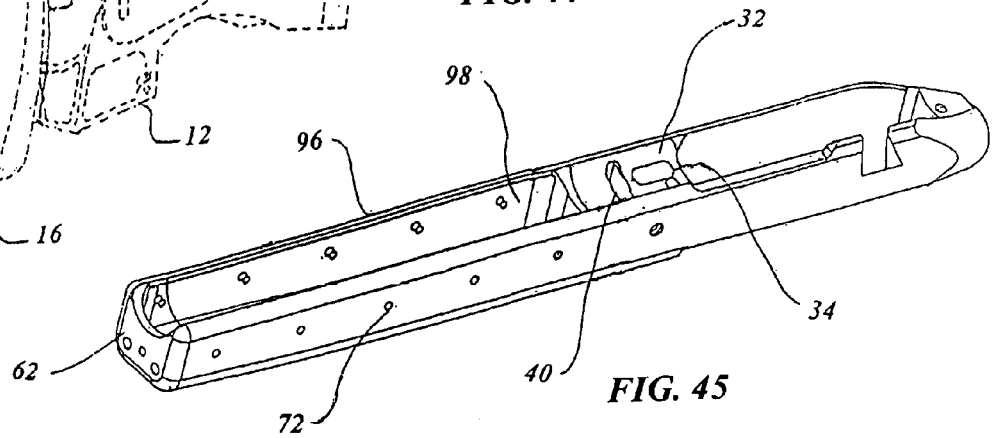
FIG. 45 is an isometric view of the one piece fore-end in the third embodiment.

The third embodiment, illustrated in FIGS. 42-43, comprises a fore-end 20 consisting of a one piece combined receiver portion and forestock portion 96 which is attached to the buttstock 12 flanged stock bolt 18 with four buttstock threaded fasteners 30.

The receiver portion has a cavity 32 forming a receiver bedding interface surface 34 which precludes peripheral interference. The receiver portion has a recoil lug pocket 40 with threaded fasteners engage a rifle action recoil lug. The buttstock, combined receiver portion and forestock portion have lightening areas 98 for reducing overall weight.

It is preferred that the one piece combined receiver portion and forestock portion 96 is made of aluminum with an anodized finish, however it is anticipated that other materials may be employed, as are presently used in firearms, which include wood, epoxy laminated wood, polymer, fiberglass and formed steel sheet material.

Other than the absence of the fore-end attaching components the remainder of the one piece stock 96 remains the identical to the preferred embodiment.

While the invention has been described in complete detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

The invention claimed is:

1. An improved tactical adaptive rifle stock which includes a multi-axis adjustable buttstock having a grip neck, a flanged stock bolt, disposed through a portion of the buttstock, wherein the improvement comprises:

a stock fore-end consisting of a receiver portion and forestock portion combined set having;

a) the receiver portion incorporating a plurality of rear threaded holes aligned in a bolt circle, interfacing with said buttstock flanged stock bolt, b) the receiver portion having a rifle action and barrel cavity, wherein a rifle action and barrel cavity form a longitudinal receiver bedding interface surface as a radius in the receiver portion is larger than a radius of a rifle action forming a uniform converging contact point permitting a front trigger guard screw and a rear trigger guard screw to apply pressure to the rifle action into constant longitudinal alignment without peripheral interference, c) the receiver portion is adapted to conform to a rifle action having recoil lug, wherein the receiver portion having a recoil lug pocket, which includes a bottom, a rear face, a front face and sides, a plurality of recoil lug front face threaded fasteners engage a front face of the recoil lug through the receiver portion forward bulkhead compressing the recoil lug against the rear face of the recoil lug pocket, and a plurality of recoil lug side threaded fasteners engage a right side and left side of the recoil lug, centering and retaining the recoil lug within the receiver portion with the recoil lug positioned above the recoil lug pocket bottom, d) the receiver portion having a locking wedge recess adjacent to the recoil lug pocket with a locking wedge, having a threaded bore, disposed therein, the receiver portion further having a vertical dovetail joint in a forward end and a semi-circular recess in a forward bottom end, e) the forestock portion having a dovetail joint, a semi-circular outwardly facing platform, a rear bulkhead and a front face, such that when the forestock portion is united with the receiver portion, utilizing the respective dovetail joint's, and the semi-circular recessed platform are juxtaposed with the semi-circular recess, a locking wedge threaded fastener is disposed in the locking wedge threaded bore tightly engaging the receiver portion with forestock portion said adapter together forming said combined set, and f) the multi-axis adjustable buttstock, receiver portion having interior lightening areas to reduce the overall weight of the tactical adaptive rifle stock.

2. The receiver portion and forestock portion combined set as recited in claim 1 are individually made of aluminum.

3. The receiver portion and forestock portion combined set as recited in claim 2 wherein said aluminum is anodized.

4. The receiver portion and forestock portion combined set as recited in claim 1 wherein said rifle action includes a barrel, and is selected from the group adapted to receive a short action receiver and a long action receiver.

5. The receiver portion and forestock portion combined set as recited in claim 1 further comprising a adapter, a connector and a noise reduction suppressor, with the adapter having a vertical dovetail joint and a semi-circular outwardly facing platform joint on each side, the connector having forwardly facing male threads and a dovetail joint that interface with said adapter, a second locking wedge with a threaded fastener interfaces with the adapter semi-circular outwardly facing platform engaging the connector and adapter together, with the suppressor secured to the connector male threads with the suppressor having female threads.

* * * * *